US011371312B2

(12) United States Patent
Greenlee et al.

(10) Patent No.: US 11,371,312 B2
(45) Date of Patent: Jun. 28, 2022

(54) CUP PLUG HAVING A LARGE FLOW-THROUGH INSIDE DIAMETER

(71) Applicant: Nine Downhole Technologies, LLC, Houston, TX (US)

(72) Inventors: Donald Roy Greenlee, Murchison, TX (US); Donald Jonathan Greenlee, Murchison, TX (US)

(73) Assignee: Nine Downhole Technologies, LLC, Houston, TX (US)

( * ) Notice: Subject to any disclaimer, the term of this patent is extended or adjusted under 35 U.S.C. 154(b) by 0 days.

(21) Appl. No.: 16/660,604

(22) Filed: Oct. 22, 2019

(65) Prior Publication Data

US 2020/0048983 A1 Feb. 13, 2020

Related U.S. Application Data

(63) Continuation of application No. 15/466,523, filed on Mar. 22, 2017, now Pat. No. 10,487,615.

(51) Int. Cl.

| | |
|---|---|
| ***E21B 33/128*** | (2006.01) |
| ***E21B 33/129*** | (2006.01) |
| ***E21B 33/134*** | (2006.01) |

(52) U.S. Cl.

CPC ..... *E21B 33/128* (2013.01); *E21B 33/1293* (2013.01); *E21B 33/134* (2013.01)

(58) Field of Classification Search

CPC .... E21B 33/128; E21B 33/1293; E21B 33/12; E21B 33/1204

See application file for complete search history.

(56) References Cited

U.S. PATENT DOCUMENTS

| | | | | |
|---|---|---|---|---|
| 5,449,040 | A * | 9/1995 | Milner | E21B 23/06 166/123 |
| 5,511,620 | A * | 4/1996 | Baugh | E21B 33/1212 166/191 |
| 6,220,349 | B1 | 4/2001 | Vargus et al. | |
| 2011/0048743 | A1 | 3/2011 | Stafford et al. | |
| 2011/0277987 | A1 | 11/2011 | Frazier | |
| 2014/0190685 | A1 | 7/2014 | Frazier et al. | |
| 2014/0251612 | A1* | 9/2014 | Powers | B29C 48/154 166/281 |
| 2014/0262344 | A1* | 9/2014 | Standridge | E21B 33/134 166/382 |
| 2015/0013965 | A1* | 1/2015 | Cox | E21B 33/129 166/192 |
| 2015/0285026 | A1 | 10/2015 | Frazier | |
| 2016/0040492 | A1* | 2/2016 | Vinson | E21B 23/06 166/386 |
| 2016/0201435 | A1* | 7/2016 | Fripp | E21B 33/134 166/376 |
| 2016/0222755 | A1* | 8/2016 | Angman | E21B 33/128 |
| 2016/0298407 | A1* | 10/2016 | Takahashi | E21B 29/02 |
| 2017/0002621 | A1* | 1/2017 | White | E21B 33/128 |
| 2018/0171748 | A1* | 6/2018 | Hou | E21B 23/01 |

* cited by examiner

*Primary Examiner* — Brad Harcourt
(74) *Attorney, Agent, or Firm* — Vinson & Elkins L.L.P.

(57) ABSTRACT

A downhole tool is configured on a wireline adapter kit in the run-in position is disclosed. The downhole tool comprises a large open bore when the downhole tool is set and the wireline adapter kit is removed, thereby allowing production to commence without removal of the downhole tool. The large bore diameter may be greater than 2 inches for a 4.5 inch casing, or greater than 2.5 inches for a 5.5 inch casing.

18 Claims, 2 Drawing Sheets

CUP PLUG HAVING A LARGE FLOW-THROUGH INSIDE DIAMETER

CROSS-REFERENCE TO RELATED APPLICATION

This application is a continuation of co-pending U.S. application Ser. No. 15/466,523, entitled "Cup Plug Having a Large Flow-Through Inside Diameter," filed Mar. 22, 2017, which is hereby incorporated by reference in its entirety.

BACKGROUND

1. Field of the Invention

The present invention relates to downhole tools for use in well bores, as well as methods for using such downhole tools. In particular, the present invention relates to downhole tools and methods for plugging a well bore with a tool having a large flow-through inside diameter that allows fluids to flow freely after the isolation process.

2. Description of the Related Art

A variety of downhole tools are used in the drilling, completion, and stimulation of hydrocarbon-producing wells. For example, it is often desirable to seal portions of a wellbore, such as during fracturing operations when various fluids and slurries are pumped from the surface into a casing string that lines the wellbore, and forced into a surrounding subterranean formation through the casing string. During the fracking process, it becomes necessary to seal the wellbore to provide zonal isolation at the location of the desired subterranean formation. Isolation tools, such as frac plugs, bridge plugs, and packers, are well known in the art for achieving zonal isolation.

These downhole tools typically can be lowered into a well bore in an unset position until the tool reaches a desired setting depth. Upon reaching the desired setting depth, the downhole tool is set. Once set, the downhole tool acts as a plug preventing fluid from traveling from above the downhole tool to below the downhole tool. After the desired operation is complete, the seal formed by the wellbore isolation tool must be broken in order to allow production operations to commence. This is generally accomplished by removing the tool, typically by a complex retrieval operation that involves milling or drilling out a portion of the tool, and subsequently mechanically retrieving its remaining portions. This milling and/or retrieving process can be a costly and time-consuming process. Prior downhole tools were typically made of very hard metals, such as steel, that are very difficult to drill through, adding significant cost and difficulty to the removal process.

Recent developments have been made to improve the removal of downhole tools. For example, U.S. Pat. No. 6,220,349 describes downhole plugs constructed of non-metallic, composite parts that are easier to drill through. As another example, U.S. Patent Publ. No. 2011/0048743 describes downhole plugs constructed of parts designed to dissolve when exposed to certain downhole conditions. Although the foregoing developments represent considerable advancements in the removal of downhole tools, there still remains a need in the industry to reduce or eliminate this time consuming removal step altogether.

SUMMARY OF THE INVENTION

The present invention discloses a downhole tool, such as a bridge plug or a frac plug, that eliminates the need for drill-out in order to re-enter the wellbore, thereby reducing the transition time to production.

In one claimed embodiment of the present invention, a downhole tool configured on a wireline adapter kit in the run-in position is disclosed, the downhole tool comprising a large open bore when the downhole tool is set and the wireline adapter kit is removed, wherein the large open bore allows production to commence without removal of the downhole tool. The large bore diameter may be greater than 2 inches for a 4.5 inch casing, or greater than 2.5 inches for a 5.5 inch casing.

In a second claimed embodiment of the present invention, a downhole tool configured on a wireline adapter kit in the run-in position is disclosed, the downhole tool comprising upper slips and lower slips configured to grippingly engage the well casing when the downhole tool is in the set position, a means for sealing the annulus between the downhole tool and the well casing when the downhole tool is in the set position, and a large open bore when the downhole tool is set and the wireline adapter kit is removed, wherein the large open bore allows production to commence without removal of the downhole tool. The large bore diameter may be greater than 2 inches for a 4.5 inch casing, or greater than 2.5 inches for a 5.5 inch casing. The wireline adapter kit comprises a setting sleeve, a tension mandrel (constructed of a high strength alloy steel), and a mule shoe. Both the setting sleeve and the upper portion of the tension mandrel are threadingly engaged to a setting tool. The mule shoe is engaged to the lower portion of the tension mandrel using shear screws. In a preferred aspect of the present invention, the downhole tool is bottom set.

In a third claimed embodiment of the present invention, a downhole tool configured on a wireline adapter kit in the run-in position is disclosed, the downhole tool comprising upper slips and lower slips configured to grippingly engage the wellbore or well casing when the downhole tool is in the set position, an upper cone slidingly engaged with the upper slips, a lower cone slidingly engaged with the lower slips, an extrusion limiter arranged adjacent to the lower cone, and a packer cup element arranged adjacent to the extrusion limiter and slidingly engaged with the upper cone. The wireline adapter kit comprises a setting sleeve arranged adjacent to the upper slips, a tension mandrel, and a mule shoe. Both the setting sleeve and the upper portion of the tension mandrel are threadingly engaged to the setting tool. The mule shoe is engaged to the lower portion of the tension mandrel and is arranged adjacent to the lower slips. The downhole tool is set by the setting tool creating a push on the setting sleeve while creating a pull on the tension mandrel, with the push on the setting sleeve setting the upper slips and the pull on the tension mandrel setting the lower slips. The pull on the tension mandrel also forces the packer cup element into sealing engagement between the upper cone and the wellbore. The downhole tool further comprises a large open bore when the downhole tool is set and the wireline adapter kit is removed, wherein the large open bore allows production to commence without removal of the downhole tool. The large bore diameter may be greater than 2 inches for a 4.5 inch casing, or greater than 2.5 inches for a 5.5 inch casing. A dissolvable ball may be seated within the downhole tool to seal the large open bore in order to conduct wellbore services. It is a preferred aspect of the present invention that one or more of the upper slips, upper cone, extrusion limiter, lower cone, and lower slips are at least partially constructed of composite materials. Alternatively, one or more of the upper slips, upper cone, extrusion limiter, lower cone, and lower slips are at least partially constructed of dissolvable materials.

DESCRIPTION OF PREFERRED EMBODIMENTS

The novel features of the present invention will be best understood by reference to the following detailed description when read in conjunction with the accompanying drawings.

DESCRIPTION OF PREFERRED EMBODIMENTS

Figure 1:
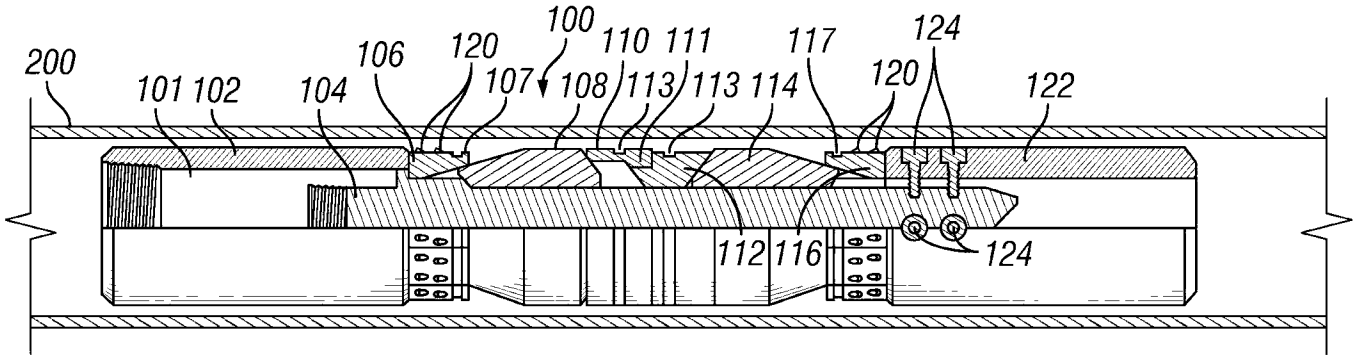
FIG. 1 shows a quarter-sectional view of a downhole tool of the present invention as the tool would appear in an un-set, run-in position.
Figure 2:
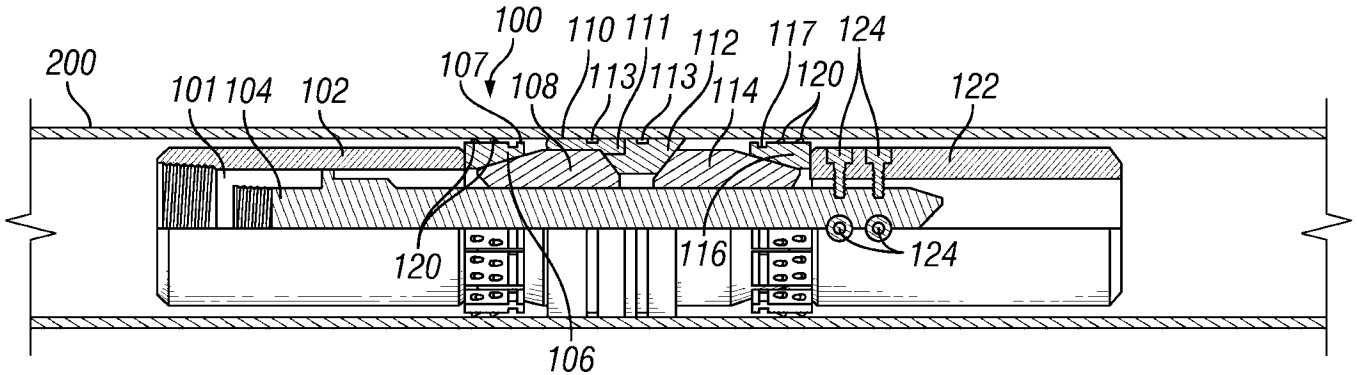
FIG. 2 shows a quarter-sectional view of the downhole tool of FIG. 1 in the set position within a well casing.

Referring generally to FIGS. 1 and 2 in the drawings, a preferred embodiment of a downhole tool of the present invention is shown and designated by the numeral 100. The plug 100 is suitable for use in oil and gas well service applications, such as a frac plug, bridge plug, or packer. When plug 100 is in an unset, run-in position, plug 100 can be raised and lowered in a well bore or well casing using a wireline. When plug 100 is in its set position, as shown in FIG. 2, the downhole tool 100 is considered to be installed, or fixed in place relative to the well bore or well casing.

Figure 3:
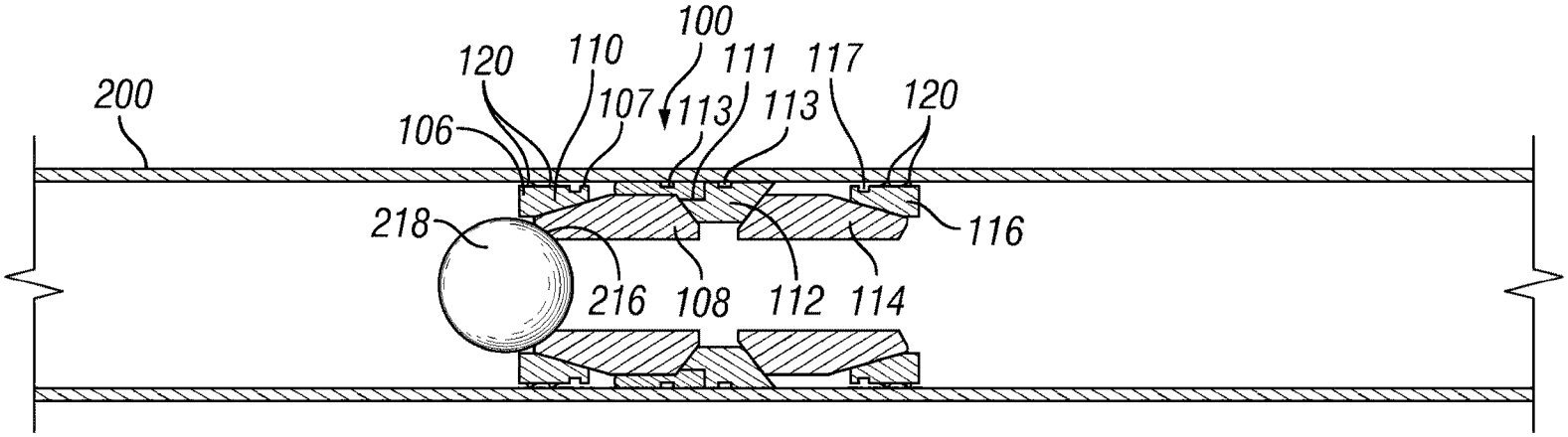
FIG. 3 shows a cross-sectional view of the downhole tool of FIG. 2 in the plugged, frac position within a well casing.
Figure 4:
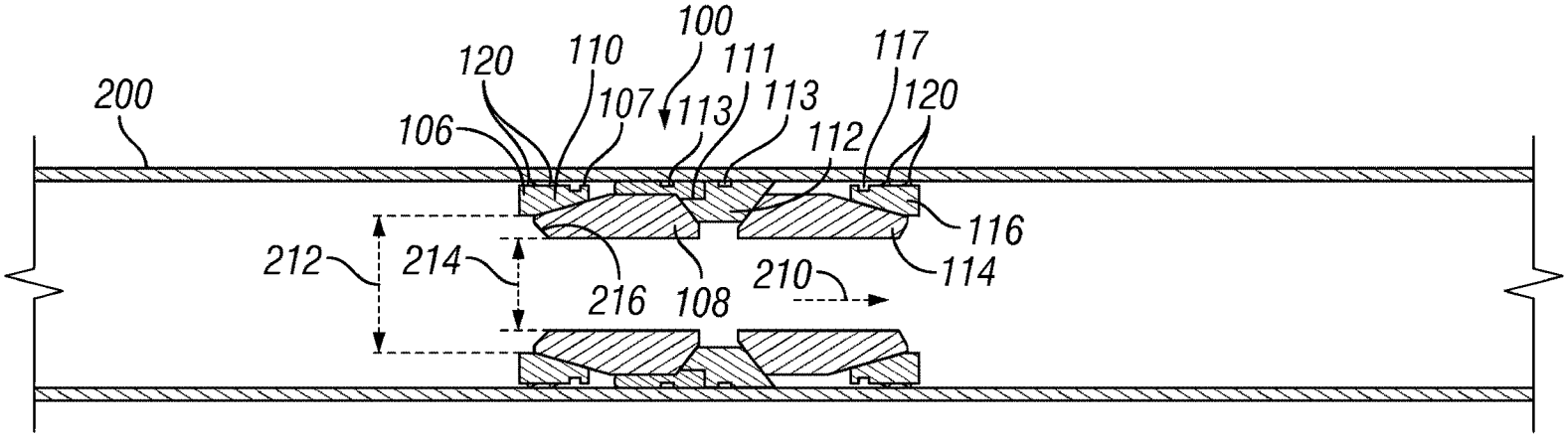
FIG. 4 shows a cross-sectional view of the downhole tool of FIG. 3 in the large bore, flow-through position.

Plug 100 is assembled directly on a wireline adapter kit (WLAK), and thus eliminates the need for a separate mandrel. When plug 100 is set, the WLAK shears off the plug and is removed from the wellbore leaving chamfered shoulder 216 on upper cone 108 for frac ball 218 to seat upon, as depicted in FIG. 3. When the application is completed and frac ball 218 is cleared, a large central opening 210 extends longitudinally through plug 100, thereby eliminating any need for drilling out or retrieval to commence production operations.

Referring to FIG. 1, plug 100 is depicted in the un-set, run-in position assembled directly to the WLAK. The WLAK comprises a setting sleeve 102 and a tension mandrel 104, both of which are threadingly engaged to setting tool 101. In a preferred embodiment of the present invention, tension mandrel 104 is engaged to mule shoe 122 using four radially oriented shear screws 124.

Upper slips 106 is arranged adjacent to setting sleeve 102, and is slidingly engaged with upper cone 108. Packer cup 110 having elastomer lip 111 is arranged adjacent to upper cone 108, and as discussed below with reference to FIG. 2, when set, is designed to expand between the well casing 200 inside diameter and the upper cone 104 outside diameter, thereby creating a plug seal. Disposed below packer cup 110 is extrusion limiter 112, lower cone 114, and lower slips 116. As is well-known in the art, upper slips 106 and lower slips 116 generally have a segmented, cylindrical body with an outer gripping surface formed by a plurality of teeth elements 120 arranged to provide constant and positive gripability of the upper slips 106 and lower slips 116 in a well casing when in the set position, as illustrated in FIG. 2. Also well-known in the art, upper slips 106 and lower slips 116 are initially held in place in the run-in position by a retaining bands 107 and 117, disposed around the outside surface of the slips segments, and which may be made of any suitable material, such as fiberglass or o-rings.

Referring now to FIG. 2, plug 100 is shown disposed in the set position against well casing 200. In a preferred embodiment, plug 100 is bottom set using setting tool 101, such as the T-SET®. series of setting tools provided by Hunting Energy Services of Houston, Tex. or any other explosive setting tool known in the art. The setting sequence starts with the setting tool 101 creating a push on setting sleeve 102, driving upper slips 106 up the angle of upper cone 108, thereby setting upper slips 108 into well casing 200. At the same time, setting tool 101 creates a pull on tension mandrel 104, moving guide shoe 122 upward and driving lower slips 116, lower cone 114, extrusion limiter 112, and packer cup 110 up the tension mandrel 104. As shown in FIG. 2 in the set position, packer cup 106 is forced by extrusion limiter 112 to expand between the well casing 200 inside diameter and the upper cone 108 outside diameter, thereby creating the plug seal. The elastomer lip 111 portion of packer cup 110 provides a pressure seal to the inside surface of the well casing 200. Furthermore, packer cup 100 and extrusion limiter 112 preferably each contain retaining band 113, which may be made of any suitable material, such as fiberglass or o-rings. According to certain aspects of the present invention, it is envisioned that packer cup 110 achieves up to 200% elongation at up to 10% radial compression. Because of this setting procedure, in conjunction with the structure of plug 100 of the present invention, the inventors have invented an apparatus and method with a limited risk of premature plug setting, further solving another problem associated with prior art plugs.

Referring now to FIG. 3, when plug 100 is set, the tension mandrel is pulled upwardly using the wireline and WLAK to shear screws 124, thereby separating mule shoe 122 and tension mandrel 104 from plug 100. Plug 100 is then in a set position as shown in FIG. 2 and the WLAK and tension mandrel 104 can be removed from the well. At this time, plug 100 consists now consists of a central bore 210 having at least two different diameters. The central bore 210 has an upper opening portion 212 and a smaller lower opening portion 214. The upper opening portion 212 and lower opening portion 214 are separated by an upwardly-facing chamfered shoulder 216 on upper cone 108, which serves as a ball seat.

Ball 218 is then disposed in the upper opening portion 212 and is adapted for engagement with shoulder 216 in the presence of downward pressure, as is shown in FIG. 3, thereby blocking the central bore 210. Also, the elastomer lip portion 110 of the packer cup 106 will bear against the well casing 140 or well bore wall in the presence of downward pressure, thereby blocking the region between the upper cone 108 and the inner surface of the well casing 140 or well bore wall. Ball 218 is preferably dissolvable, such as the GEOBall™. Dissolvable Ball, distributed by GEODynamics, Inc. of Millsap, Tex. The outside diameter of ball 218 is smaller than the inner diameter of the upper opening portion 212, but larger than the inner diameter of the lower opening portion 214. The downhole tool 100 can now hold fracturing pressure from above downhole tool 100.

Once ball 218 has dissolved or otherwise cleared from central bore 210, plug 100 does not need to be removed from the wellbore in order to commence production operations. According to certain embodiments of the present invention, central bore 210 of plug 100 has a set inside diameter preferably greater than 2.0", more preferably greater than 2.5", and most preferably greater than 3.0" or more, in order to allow fluids to flow freely through the tool after the fracking (or other workover) process is completed. As such, one important aspect of the present invention is that operators can re-enter the wellbore, if needed, and without removing plug 100, with 2⅞" tubing or production tubing.

The foregoing disclosure describes a plug 100 capable of expediting well completion and stimulation services by eliminating any need for drilling out or retrieval to commence production operations. In a first preferred embodiment, plug 100 is constructed of primarily composite materials. For example, any one or more of upper slips 106, upper cone 108, extrusion limiter 112, lower cone 114, and lower slips 116 may be constructed of a filament wound fiberglass/resin, or a molded thermoset plastic, as is well known in the art. Packer cup 110 is preferably made from a nitrile elastomeric material, suitable for forming a tight seal against well casing 200 when plug 100 is set. In second preferred embodiment, plug 100 may be constructed of primarily dissolvable materials. For example, any one or more of upper slips 106, upper cone 108, extrusion limiter 112, lower cone 114, and lower slips 116 may be constructed of a magnesium alloy, with packer cup 110 made from a degradable elastomeric material. In a third preferred embodiment, plug 100 may be constructed as a hybrid of the above two embodiments.

In one illustrative embodiment of the present invention, for a casing size of 5.5" (17 lb/ft), plug 100 has an un-set outside diameter of 4.37" and uncompressed total length of 15.36", with a corresponding set inside diameter of 2.50" and set length of 9.85". This provides an installed flow area for central bore 210 of 4.9 $in^2$.

In another illustrative embodiment of the present invention, for a casing size of 5.5" (20 lb/ft), plug 100 has an un-set outside diameter of 4.50" and uncompressed total length of 15.36", with a corresponding set inside diameter of 3.90" and set length of 9.85". This provides an installed flow area for central bore 210 of 11.9 $in^2$.

In yet another illustrative embodiment of the present invention, for a casing size of 5.5" (23 lb/ft), plug 100 has an un-set outside diameter of 4.38" and uncompressed total length of 15.36", with a corresponding set inside diameter of 3.77" and set length of 9.85". This provides an installed flow area for central bore 210 of 11.2 $in^2$.

In still yet another illustrative embodiment of the present invention, for a casing size of 4.5" (15.1 lb/ft), plug 100 has an un-set outside diameter of 3.50" and uncompressed total length of 15.36", with a corresponding set inside diameter of 2.90" and set length of 9.85". This provides an installed flow area for central bore 210 of 6.6 $in^2$.

In still another illustrative embodiment of the present invention, for a casing size of 4.5" (13.5 lb/ft), plug 100 has an un-set outside diameter of 3.63" and uncompressed total length of 15.36", with a corresponding set inside diameter of 3.02" and set length of 9.85". This provides an installed flow area for central bore 210 of 7.2 $in^2$.

In a further illustrative embodiment of the present invention, for a casing size of 4.5" (11.6 lb/ft), plug 100 has an un-set outside diameter of 3.75" and uncompressed total length of 15.36", with a corresponding set inside diameter of 3.15" and set length of 9.85". This provides an installed flow area for central bore 210 of 7.8 $in^2$.

Another preferred embodiment of the present invention is a method for completing a well and a method for reducing time for well completion, comprising installing plug 100 as described hereinabove, performing fracking operations, dissolving or otherwise removing ball 218, and commencing production operations without removing or retrieving plug 100.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention.

What is claimed is:

1. A downhole tool comprising:

slips configured to grippingly engage a well casing when the downhole tool is set;

a cone slidingly engaged with the slips, the cone comprising an open bore through the cone axially aligned with the cone;

an extrusion limiter engaged by the cone; and a packer cup element located adjacent to the extrusion limiter and slidingly engaged with the cone, wherein the downhole tool is adapted to be set using a wireline adapter kit after run-in, and the wireline adapter kit includes a tension mandrel to which the downhole tool is attached during run-in, wherein the wireline adapter kit comprises a setting sleeve located adjacent to the slips, and wherein a mule shoe is enabled to engage the cone to set the downhole tool.

2. The downhole tool of claim 1, wherein the downhole tool has an outside diameter, and wherein the open bore has an inside diameter, and wherein the ratio of the inside diameter to the outside diameter is greater than 0.57.

3. The downhole tool of claim 1, wherein the downhole tool has an outside diameter, and wherein the open bore has an inside diameter, and wherein the ratio of the inside diameter to the outside diameter is greater than 0.86.

4. The downhole tool of claim 1, wherein the cone further comprises an upwardly-facing chamfered shoulder.

5. The downhole tool of claim 1, wherein one of the slips, cone, extrusion limiter, or packer cup is constructed of a composite material selected from a filament wound fiberglass/resin or molded thermoset plastic.

6. The downhole tool of claim 1, wherein one of the slips, cone, extrusion limiter, or packer cup is at least partially constructed of dissolvable materials.

7. The downhole tool of claim 1, wherein the packer cup comprises an elastomer lip around the outside perimeter of the packer cup to provide a pressure seal to the well casing.

8. The downhole tool of claim 1, wherein the tension mandrel is further enabled to engage the cone to set the downhole tool; and wherein both the setting sleeve and the tension mandrel are threadingly engaged to a setting tool.

9. The downhole tool of claim 8, wherein the mule shoe is engaged to the tension mandrel at an opposite end of the tension mandrel from the setting tool, and the mule shoe is located adjacent to a lower end of the slips.

10. A method of deploying downhole tool assemblies, the method comprising:

running a downhole tool assembly into a casing of a wellbore utilizing a mandrel of a wireline adapter kit attached to the downhole tool assembly, wherein the downhole tool comprises:

slips configured to grippingly engage a well casing when the downhole tool is set, a cone slidingly engaged with the slips, the cone comprising an open bore through the cone axially aligned with the cone, an extrusion limiter engaged by the cone, and a packer cup element located adjacent to the extrusion limiter and slidingly engaged with the upper cone; and wherein the downhole tool is adapted to be set using a wireline adapter kit after run-in, and the wireline adapter kit includes a mandrel to which the downhole tool is attached during run-in, and wherein the wireline adapter kit comprises a setting sleeve located adjacent to the slips;

simultaneously creating a pushing force and a pulling force on the downhole tool assembly to set the downhole tool assembly in the casing to create a seal between the downhole tool and the casing;

removing at least a portion of the wireline adapter kit to leave at least a portion of the downhole tool assembly sealed in the casing, including removing the mandrel of the wireline adapter kit from the downhole tool assembly;

wherein the cone forms an inner bore in fluid communication with the casing that enables production from the casing;

wherein the wireline adapter kit further comprises a mule shoe enabled to engage the cone to set the downhole tool.

11. The method of claim 10, wherein the downhole tool has an outside diameter, and wherein the open bore has an inside diameter, and wherein the ratio of the inside diameter to the outside diameter is greater than 0.57.

12. The method of claim 10, wherein the downhole tool has an outside diameter, and wherein the open bore has an inside diameter, and wherein the ratio of the inside diameter to the outside diameter is greater than 0.86.

13. The method of claim 10, wherein the cone further comprises an upwardly-facing chamfered shoulder.

14. The method of claim 10, wherein one of the slips or the cone is constructed of a composite material selected from a filament wound fiberglass/resin or molded thermoset plastic.

15. The method of claim 10, wherein one of the slips, cone, extrusion limiter, or packer cup is at least partially constructed of dissolvable materials.

16. The method of claim 10, wherein the packer cup comprises an elastomer lip around the outside perimeter of the packer cup to provide a pressure seal to the well casing.

17. The downhole tool of claim 10, wherein both the setting sleeve and the mandrel are threadingly engaged to a setting tool.

18. The downhole tool of claim 17, wherein the mule shoe is engaged to the mandrel at an opposite end of the mandrel from the setting tool, and the mule shoe is located adjacent to a lower end of the slips.

* * * * *